United States Patent [19]

Groat et al.

[11] 3,935,980

[45] Feb. 3, 1976

[54] CONTINUOUS TAPE PAYING APPARATUS

[75] Inventors: James E. Groat; Stanley C. Hobson, both of Orange, Calif.; Lawrence B. Woolman, Marion, Ind.

[73] Assignee: The Anaconda Company

[22] Filed: Mar. 4, 1974

[21] Appl. No.: 448,087

[52] U.S. Cl. ..... 226/43; 226/118; 242/183

[51] Int. Cl.[2] ..... B65H 17/42

[58] Field of Search ..... 226/118, 119, 43, 110; 242/75.51, 180, 182–185; 271/272, 273

[56] References Cited

UNITED STATES PATENTS

| | | | |
|---|---|---|---|
| 1,883,987 | 10/1932 | Lasowsky | 226/118 X |
| 2,974,952 | 3/1961 | Zeuthen | 271/273 X |
| 3,123,269 | 3/1964 | Morley | 226/118 |
| 3,155,022 | 11/1964 | Schwertz | 226/118 X |
| 3,825,198 | 7/1974 | Ochninger | 226/118 X |

FOREIGN PATENTS OR APPLICATIONS

| | | | |
|---|---|---|---|
| 1,272,173 | 8/1960 | France | 226/119 |

*Primary Examiner*—Richard A. Schacher
*Attorney, Agent, or Firm*—Pennie & Edmonds

[57] ABSTRACT

Continuous, uninterrupted paying of paper tape into a cable-making machine is made possible at high speed by an accumulating chamber for a folded supply of the tape. A pair of pinch rolls, one of which oscillates around the other, directs the paper to form uniform folds.

9 Claims, 2 Drawing Figures

CONTINUOUS TAPE PAYING APPARATUS

BACKGROUND OF THE INVENTION

In the manufacture of articles of indefinite length such, for an important example, as electric cables it is required to pay a paper tape continuously into the manufacturing operation. The paper is supplied in packages, such as pads or pancakes of finite size so that when one pad is exhausted the leading end of the tape on a fresh pad must be spliced onto the trailing end of the exhausted pad. In the older methods of cable making utilizing braiding machines and the like, operating at relatively slow speed, there was ample time to make such a splice by using the last few turns of an exhausted pad, for slack. This is not possible, however, for present high speed extrusion operations, where economical manufacture demands long uninterrupted paying of one pad of tape after another into the extrusion machine. This problem exists also with fabric and plastic tapes but the fragility and lack of stretch of paper has made continuous paying out more difficult. It was recognized that if some method or apparatus were available for accumulating a large supply of paper tape, a fresh pad could be spliced in while the accumulated supply was being exhausted, but if the splices themselves were frequently to break, upon being paid from the accumulator, such apparatus would have little commercial value. What was needed was a tape accumulator offering no obstruction to the swift advance of the double tape thickness at the splice and no significant inertia to resist the rapid exhaustion of the accumulated supply of tape.

SUMMARY

We have invented an accumulator, for use in the continuous paying out of tape, comprising an upright rectangular chamber with two parallel side walls separating a width of the chamber to slightly exceed the width of the tape, forward and rearward end walls joining the side walls, and a horizontal partition defining a bottom passageway for the tape, with the partition being spaced from the rearward end wall. Our accumulator has means, such, for a preferred example, as a pair of driven pinch rolls, for continuously introducing the tape into the top of the chamber approximately midway between the end walls and arcuate guide means, such as a rotatable roll, for the tape, mounted between the rearward end wall and the partition, and an opening in the forward end wall communicating with the passageway for continuously paying out the tape.

We have invented an apparatus for piling folds of tape comprising a first roll mounted on a horizontal axis in the path of the tape and a second roll mounted on a horizontal axis so as to pinch the tape against the first roll. We provide means for oscillating the axis of the second roll in an arc around the first roll with the arc extending from an elevation higher to an elevation lower than the elevation of the axis of the first roll. Means may advantageously be included for driving the first roll.

We have invented apparatus for paying a continuous length of paper tape to an application station, from a plurality of pads of the tape, comprising means rotatably mounting first and second pads of tape on horizontal axes, a narrow chamber for accumulating folds of the tape, means guiding the withdrawal of the tape to the station from the bottom of the chamber and means selectively driving the tape from either of the pads into the chamber at a central overhead point, the driving means advancing the tape at a rate in excess of the rate of withdrawal, thereby accumulating tape in the chamber we provide means, such as a photocell, for sensing the quantity of tape in the chamber and means actuated by the sensing means for controlling the driving means. Advantageously our apparatus comprises driving means, such as endless belts, for the pads, controlled by means actuated by the sensing means.

DETAILED DESCRIPTION OF PREFERRED EMBODIMENT

Figure 1:
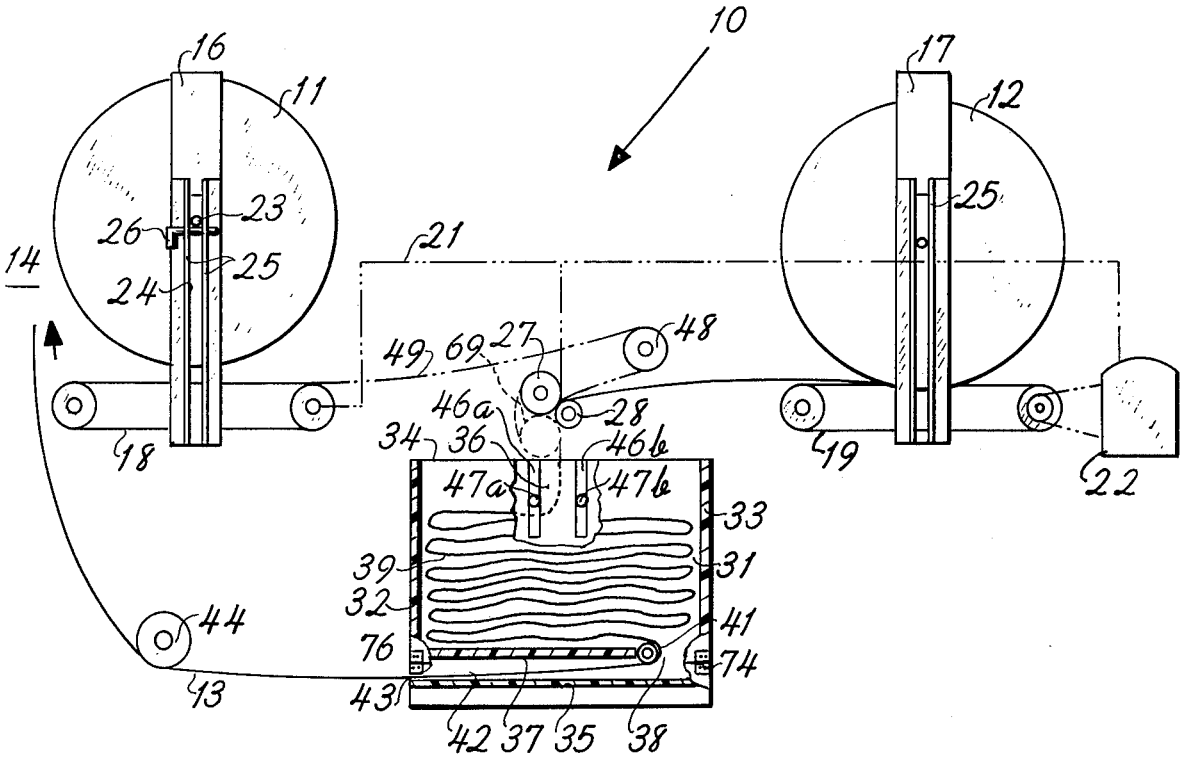
FIG. 1 shows a side view, partially in section, of an apparatus of our invention.

In the accumulating apparatus, indicated generally by the numeral 10 pads 11, 12 of paper tape 13 being paid to an application station 14 are mounted in frames 16, 17 to rest on endless belts 18, 19 driven by a gear train 21 from a motor 22. As illustrated the pad 12 is being paid out while the pad 11 is standby. The pad 11 can be prevented from rotating either by disengaging the gearing to the belt 18 in a known manner or by locking an axis of a roller 23 in a raised position in slots 24 of the frame 16 by means of a pin 26 passed through apertures in flanges 25 of angles forming the frames. Tape 13 from the pad 12 pays directly over a pair of pinch rolls 27, 28 of which the roll 28 is mounted in a fixed position and is driven at the same speed as the belt 19 by an extension 29 of the gear train 21. The roll 27 oscillates in an arc around the roll 28 by a mechanism shown in detail in FIG. 2 to direct the tape into a chamber 31 alternately toward a forward end wall 32 and a rearward end wall 33 of the chamber. Two side walls 34, 36 determine the width of the chamber 31 which is slightly in excess of the width of the tape 13. In a particular commercially successful embodiment of our invention, where longitudinal paper of 2 or 2½ inch tapes is applied at speeds up to 1500 feet per minute to a cable extrusion machine the width of the chamber 31 between the walls 34, 36 is 2¾ inches. In this embodiment the length of the chamber 31 is 52 inches and its height is 34 inches. A thousand feet of tape can be accumulated in an apparatus of these dimensions, providing ample time for splicing in a new pad, as shall be explained, even at the described high rate of paper feed. A horizontal partition 37 or false bottom extends between the walls 34, 36 but is spaced at 38 from the end wall 33. Folds 39 of the tape 13 are supported on this partition and pay through the space 38 over a roll 41 through a passageway 42 formed at the bottom of the accumulating chamber 31 by the partition 37 and a bottom member 35. An opening 43 in the wall 32 communicates with the passageway 42 for feeding the tape, which passes under a guide roll 44 to the area of application 14, not shown. The motor 22 is set to drive the belt 19 and roll 28 at a surface speed about 0.2 percent faster than the extruder speed which determines the rate of paper pay-off, thus providing for an accumulation of tape that is seemingly slow but is actually more than sufficient to fill the accumulator before a fresh pad must be spliced in. To prevent excess accumulation, the walls 34, 36 have slots **46*a*, 46*b* so that photocells 47*a*, 47*b* can slow down or stop the motor 22** when the chamber 31 is full and restart it when space is available. A time delay in the motor control circuit is employed, in a manner known for such time delays, to prevent the circuit relays from being activated by the mere dropping of single strips of tape across the line of sight of the photocell. The pad 12 pays directly over the roll 27, and an idler roll 48 is provided to guide a tape shown in phantom at 49 from the fresh pad 11 when the pad 12 is exhausted.

Figure 2:
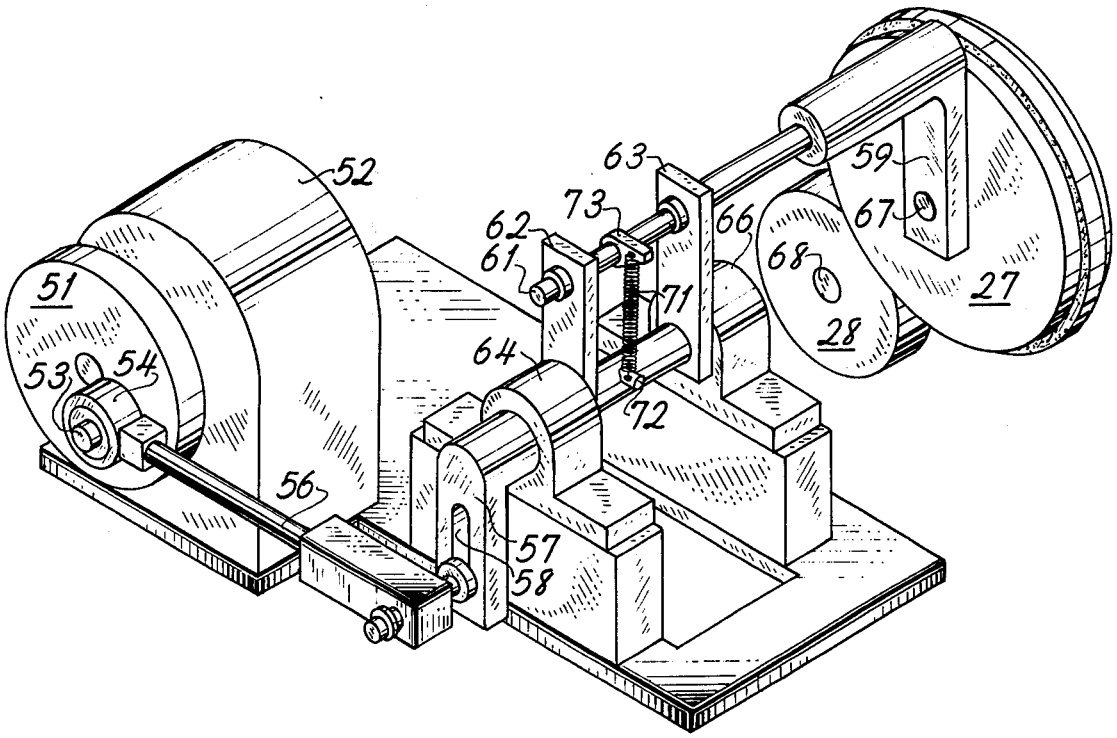
FIG. 2 shows a pictorial view of the oscillating feature of our invention.

By referring to FIG. 2 a mechanism for oscillating the roll 27 around the roll 28 can be understood. A wheel 51 mounted on a motor reducer 52 has an eccentric stub shaft 53 supporting a bearing 54 connected to a link 56 pivoted to a crank 57. The crank 57 is slotted at 58 so that the radius arm of the link can be adjusted at a length exceeding the turning radius of the stub to provide a desired arc of oscillation. A second crank 59 supporting the roll 27 is fixed to the end of a shaft 61 rotatably supported in crank arms 62, 63. The crank 57 is free to turn in bearings 64, 66 moving an axis 67 of the roll 27 from an elevation, as shown above an axis 68 of the roll 28 to an elevation below that axis (shown in phantom at 69 of FIG. 1). The crank 59 is continuously urged clockwise (as seen in FIG. 2) by a tension spring 71 fastened between a pin 72 on the crank 57 and a lever arm 73 on the shaft 61, thus keeping the two rolls pressed together.

During each cycle of oscillation the tape is urged toward the rearward wall 33 when the roll 27 is at the lower position and is urged toward the forward wall 32 when the roll 27 is at its upper position.

OPERATION

In the operation of our apparatus either or both of the pads 11, 12 can be mounted in its frame 16 or 17. Assuming the pad 11 is being paid off the tape 13 is threaded over the idler 48 and between the rolls 27, 28; over the roll 41, through the passageway 42 and opening 43, under the guide roll 44 to the station 14. For the purpose of stringing, the wall 36 of the chamber 31 is conveniently hinged by hinges 74, 76, so that it can be opened out of the way but other means of gaining access to the interior of the chamber 31 can be practiced, within the scope of our invention. The pad 12 is suspended in a raised position from the belt 19 and the motor 22 is started, to feed tape into the chamber 31. The motor-reducer 52 is started, to oscillate the roll 27. It is a simplifying feature of our apparatus that we have found no fixed connection to be required between the motors 22 and 52. In the embodiment hereinabove described an oscillation speed of 20 cycles per minute resulted in full length folds and smooth pay off of the tape 13. Before the roll 11 is exhausted, enough paper will have accumulated in the chamber 31 to cause the photocell circuit to shut off the motor 22 possibly several times. Continued oscillation of the roll 27 during these brief periods does no harm so that the motor-reducer 52 is permitted to operate continuously. When the roll 11 reaches a predetermined point close to exhaustion an audible signal is given by conventional means, not shown, the motors 22 and 52 are manually switched off, and the trailing end of the roll 11 is spliced to the leading end of the pad 12. The pins 26 are removed to lower the pad 12 to the belt 19 and the motors are started again. During the motor shutdown the accumulated folds of paper 39 have been used to supply the station 14 without interruption. When the splices between the two pads is paid from the apparatus it is not subjected to any significant tension or forced to pass through any constriction that might cause it to tear apart. A fresh pad can now be mounted in the frame 16 and temporarily supported by pins 26.

The foregoing description has been exemplary rather than definitive of our invention for which we desire an award of Letters Patent as defined in the following claims:

We claim:

1. An accumulator, for use in the continuous paying out of tape, comprising:

A. an upright rectangular chamber comprising two parallel side walls defining a width to said chamber slightly exceeding the width of said tape, forward and rearward end walls joining said side walls, and a horizontal partition defining a bottom passageway for said tape, said partition being spaced from said rearward end wall, B. drive means continuously introducing said tape into the top of said chamber approximately midway between said end walls and movable for producing folds in the tape such that the tape is storable in said chamber in an accordion fashion, C. arcuate guide means for said tape, said guide means being mounted between said rearward end wall and said partition, and D. an opening in said forward end wall communicating with said passageway for continuously paying out said tape.

2. The accumulator of claim 1 wherein said arcuate means comprises a roll rotatably mounted between said side walls.

3. The accumulator of claim 1 wherein said driving means comprises a pair of pinch rolls and means driving said rolls.

4. The accumulator of claim 3 comprising means for moving the axis of one of said rolls in an arc extending to elevations above and below the axis of the other of said rolls thereby directing said tape alternately toward said forward and said rearward end walls.

5. Apparatus for paying a continuous length of paper tape to an application station, from a plurality of pads of said tape, comprising:

A. means rotatably mounting first and second pads of said tape on horizontal axes, B. a narrow chamber for accumulating folds of said tape, C. means guiding the withdrawal of said tape to said station from the bottom of said chamber, D. drive means selectively driving said tape from either of said pads into said chamber at a central overhead point, said driving means advancing said tape at a rate in excess of the rate of withdrawal of said tape and movable for producing folds in the tape such that said tape is enabled to be accumulated in an accordion fashion in said chamber, E. means sensing the quantity of said tape in said chamber, and F. means, actuated by said sensing means, for controlling said driving means.

6. The apparatus of claim 5 comprising driving means for said pads, said pad driving means being controlled by means actuated by said sensing means.

7. The apparatus of claim 5 wherein said tape driving means comprises first and second pinch rolls and means oscillating the axis of said second roll in an arc around the axis of said first roll.

8. The apparatus of claim 5 wherein said sensing means comprises a photocell.

9. The apparatus of claim 6 comprising endless belts drivably supporting said pads.

* * * * *